United States Patent [19]

Brilloit

[11] 4,037,331

[45] July 26, 1977

[54] FREEZE-DRYING APPARATUS

[75] Inventor: Jacques Brilloit, Grenoble, France

[73] Assignee: L'Air Liquide, Societe Anonyme pour l'Etude et l'Exploitation des Procedes Georges Claude, Paris, France

[21] Appl. No.: 650,000

[22] Filed: Jan. 19, 1976

[30] Foreign Application Priority Data

Jan. 22, 1975 France ..... 75.01880

[51] Int. Cl.[2] ..... F26B 13/30; F26B 5/06; F26B 5/12

[52] U.S. Cl. ..... 34/92; 34/5; 34/135

[58] Field of Search ..... 34/5, 92, 135; 214/18 K

[56] References Cited

U.S. PATENT DOCUMENTS

| | | | |
|---|---|---|---|
| 2,029,126 | 1/1936 | Rybeck | 214/18 K |
| 3,088,222 | 5/1963 | Mace et al. | 34/5 |
| 3,751,820 | 8/1973 | Brilloit | 34/92 |

*Primary Examiner*—John J. Camby
*Attorney, Agent, or Firm*—Young & Thompson

[57] ABSTRACT

This invention relates to freeze-drying of particles of material, for example biological, pharmaceutical and food products.

Ordinarily the apparatus used for this purpose has comprised at least one rotary sublimation enclosure each fitted with at least one agitating vane which normally operates about a horizontal axis, but this produces certain disadvantages. According to the present invention, in addition to this vane which is adapted to form a catchment trough when passing through a lower zone of the enclosure and a chute emptying into an axial discharge zone when it ascends, there is provided a cylindrical set of longitudinal vanes which continue on from this agitating vane. Means are also provided for transferring particles from the cylindrical set of vanes to the agitating vane which forms the catchment trough and discharge chute.

3 Claims, 7 Drawing Figures

FREEZE-DRYING APPARATUS

BACKGROUND OF THE INVENTION

The present invention relates to apparatus for freeze-drying particles of material, of the kind which has a rotary sublimating enclosure equipped with agitator or tumbler vanes which normally operate about a horizontal axis.

Freeze-drying apparatus is already known having a sublimating enclosure fitted with a frusto-conical set of vanes, the vanes each being adapted to form catchment troughs when they passed through a lower zone of the said enclosure and to form chutes emptying into an axial discharge area when they ascended. In this way, when it was desired at the end of sublimation to extract the particles automatically, it was sufficient to open a downwardly inclined discharge passage which began at the said axial zone, preferably by placing a discharge deflector in the path of the particles as they flowed from the said vanes towards the axial area. An apparatus of this type has undeniable advantages, due to the fact that it is possible to discharge the particles automatically at the end of the freeze-drying process, which, if required, allows them to be kept under vacuum or in a controlled atmosphere. A completely cylindrical freeze-drying enclosure will not allow discharge by this method. However, agitating the particles during sublimation by means of a frusto-conical set of vanes of the kind described above has the drawback that the agitation is too violent, being far more vigorous than that from a cylindrical set of vanes, and results in the formation of "fines", which are particularly undesirable in certain applications.

It is an object of the invention to provide a freeze-drying method and aparatus which enable the advantage of automatic discharge achieved with a frusto-conical set of vanes to be combined with that of the gentle and homogeneous agitation achieved with a cylindrical set of vanes.

SUMMARY OF THE INVENTION

The invention provides a freeze-drying apparatus is characterised in that it has, besides at least one catchment and discharge vane, a cylindrical set of vanes which continue on from the said catchment and discharge vane, and means for transferring the particles from the said cylindrical set of vanes to the said catchment and discharge vane. These transfer means are advantageously formed by deflectors which are so arranged between the vanes making up the cylindrical set as to form a helical transfer screw.

BRIEF DESCRIPTION OF THE DRAWINGS

The features and advantages of the invention will become apparent from the following description, which is given by way of example with reference to the accompanying drawings, in which.

DETAILED DESCRIPTION OF PREFERRED EMBODIMENTS

Figure 1:
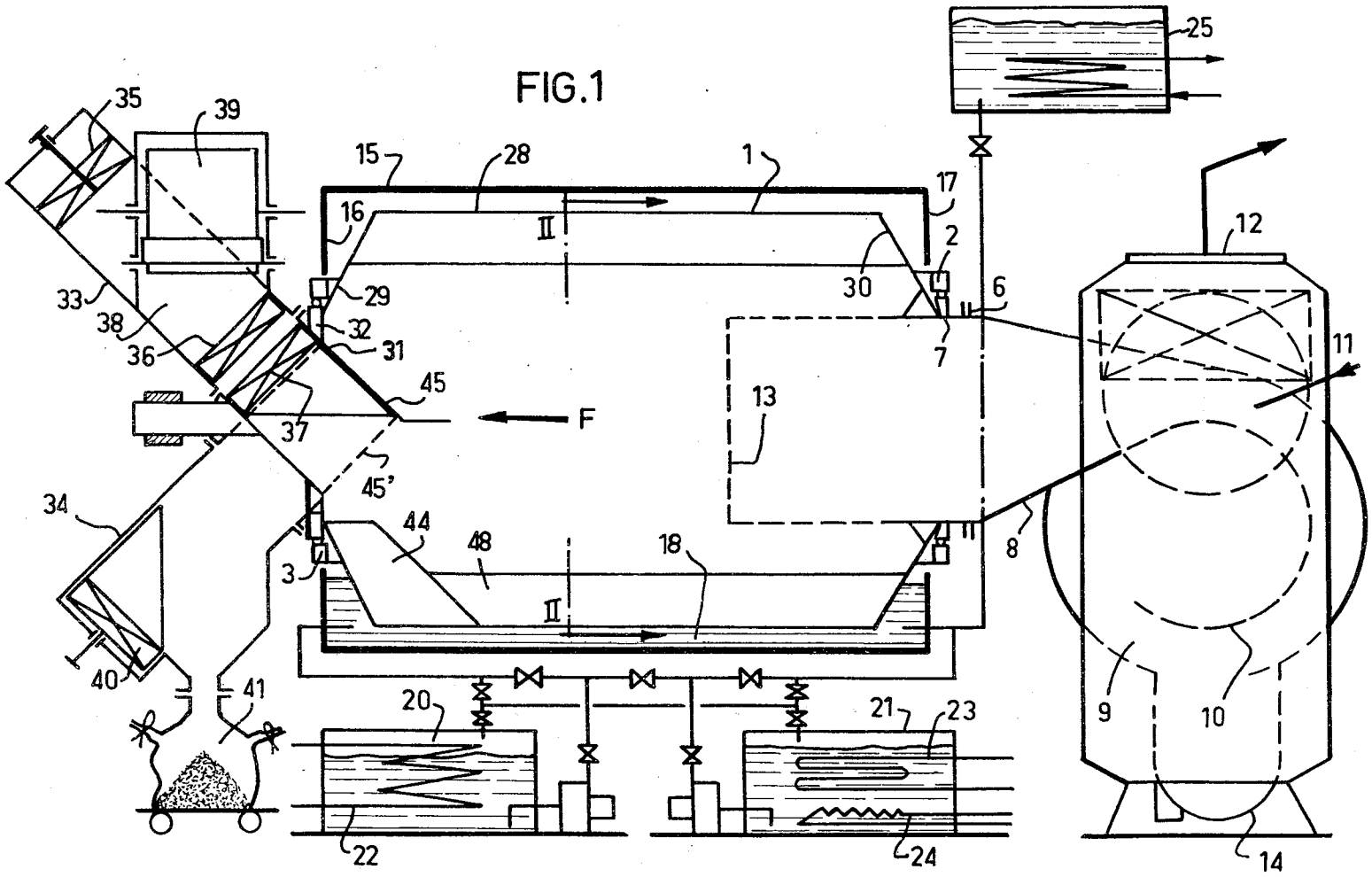
FIG. 1 is a schematic axial section through a freeze-drying apparatus according to the invention.

Referring to FIGS. 1 to 6, a freeze-drying apparatus has a sublimating enclosure or cylinder 1 which is mounted to rotate about a horizontal axis in bearings 2 and 3, being driven by a motor 4 via a chain 5 which engages with a large diameter axial conduit 6 which is attached to the mouth of an appropriate opening 7 in cylinder 1.

The axial conduit 6 is connected (FIG. 1), by a frusto-conical passage 8, to a cyclone separator 9 which has a condenser 10 using liquid nitrogen. The liquid nitrogen is introduced at 11 and removed at 12. A wide filter 13 is positioned inside the cylinder to block opening 7. The arrangement just described enables water vapour or the vapour of other evaporable substances contained in the particles in the cylinder 1 after sublimating to be trapped in condenser 10, while any "fines" which may have been picked up are collected in a sump 14.

The sublimating cylinder 1 is located in a fixed, coaxial, cylindrical housing, whose end-walls 16 and 17 form supports for bearings 2 and 3 and of which the lower part forms a tank 18 for a heating liquid. The temperature of this liquid is closely maintained by means of two feed tanks 20 and 21, one of which may exercise a cooling function for example, by means of liquid nitrogen which is injected into circuit 22 in tank 20, and the other of which may exercise a heating function by means of steam which is injected into circuit 23 in tank 21 and by means of an auxiliary resistance heater 24. Also provided is a coolant supply tank 25. The arrangement described above thus enables the heating or cooling effect which is required to sublimate the particles being freeze-dried to be exerted through the conductive wall of cylinder 1.

The cylinder 1 is mainly formed by a cylindrical portion 28 which terminates in two frusto-conical end portions 29 and 30, which represent respectively the end at which the particles are introduced and discharged and the end at which the sublimation vapours are extracted.

Whereas the frusto-conical shape of the part 30 which is situated at the end where the sublimation vapours are extracted performs no technical function and this part could be produced as a dished or flat end, frusto-conical part 29 on the other hand, which is situated at the end where the passage for introducing and removing the particles is situated, performs a function to which reference will soon be made. At its end of smaller cross-section, frusto-conical part 29 has an opening 31 which communicates, via a sealed bearing 32, on the one hand with a passage 33 for admitting particles which is downwardly inclined towards 31, and on the other hand with a passage 34 for discharging particles which is downwardly inclined away from opening 31. Admission passage 33 is provided with valves 35, 36 and 37 which allow an inlet lock 38 to be formed for particles which are stored in a storage freezer 39. Discharge passage 34, which is fitted with a valve 40, opens onto a receptacle 41 for freeze-dried particles.

The frusto-conical part 29 is provided with a set of vanes 44 which form troughs for catching particles when in their low position and chutes for discharging into opening 31 when they rise. It will be appreciated that the particles are discharged simply as a result of the rotation of the vanes 44 which agitate the particles, assuming that a discharge deflector 45, which is normally in the inoperative position (shown in solid lines in FIG. 1), is rotated through 180° about the axis of the cylinder and is brought to a position 45' (shown as a broken line) in which it catches the particles leaving vanes 44 and thus directs them into discharge passage 34.

The cylindrical part 28 of the cylinder 1 is provided with set of vanes 48 parallel to its axis, the cross-section of which vanes is triangular. Between vanes 48 are positioned discharge guides 49 which are made up of deflecting walls 50 and coaxial blanking-off walls 51 and radial blanking-off walls 52. Guides 49 are positioned in a helical line 53 (FIG. 4) and it can be seen that, when the cylinder 1 turns in direction of rotation *f*1, the particles which it agitates will move axially in direction F whereas, when cylinder 1 turns in the opposite direction *f*2, the guides 49, due to their radial walls 52, will have no effect on the particles. In the arrangement described, the frusto-conical wall 29 with the vanes 44 lies in direction F with respect to the cylindrical portion 28 of cylinder 1.

The freeze-drying apparatus thus operates as follows: the particles enter through inlet passage 33 and are received, simply by flowing under gravity and by virtue of the action of deflector 45, which is in the raised position, by the vanes 48 in the cylindrical part 28 of cylinder 1, which latter is revolving in direction *f*2.

During the sublimation period, cylinder 1 continues to rotate in direction *f*2 and the particles are agitated solely by the vanes 48 in the cylindrical portion 28. When sublimation is complete, the direction of rotation of cylinder 1 is changed from *f*2 to *f*1, at the same time as deflector 45 is moved to the lowered position 45'. The particles are then transferred progressively from the vanes 48 in the cylindrical portion 28 to the vanes 44 in the frusto-conical portion 29 and thence, as indicated above, to the discharge passage.

Figure 2:
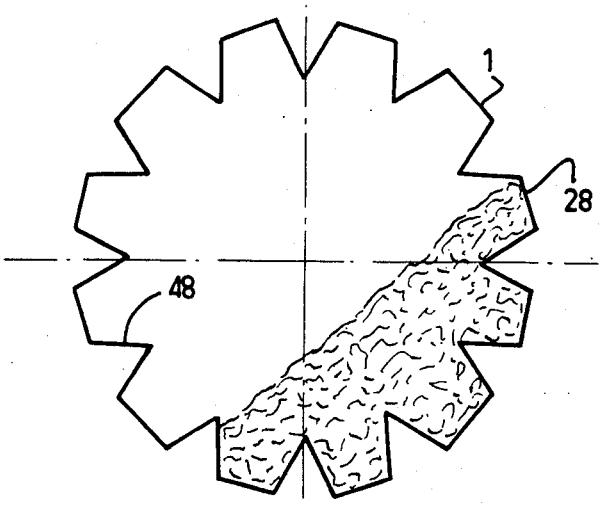
FIG. 2 is a schematic cross-section on line II—II of FIG. 1 of the sublimating cylinder of the freeze-drying apparatus.
Figure 3:
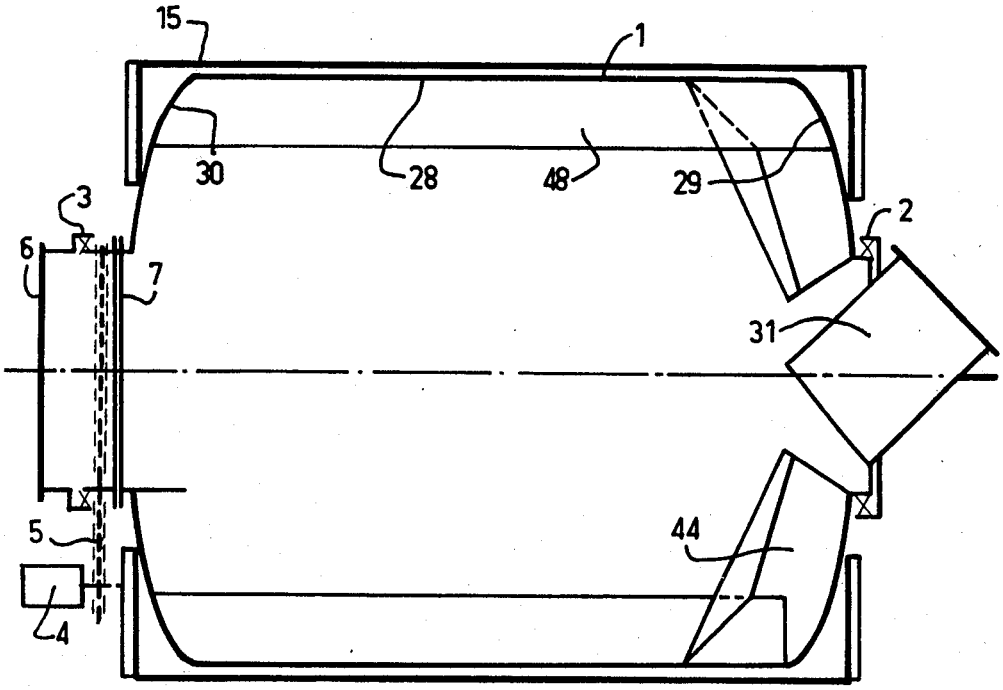
FIG. 3 is an axial section similar to FIG. 1 showing in particular the means of driving the sublimating cylinder.
Figure 5:
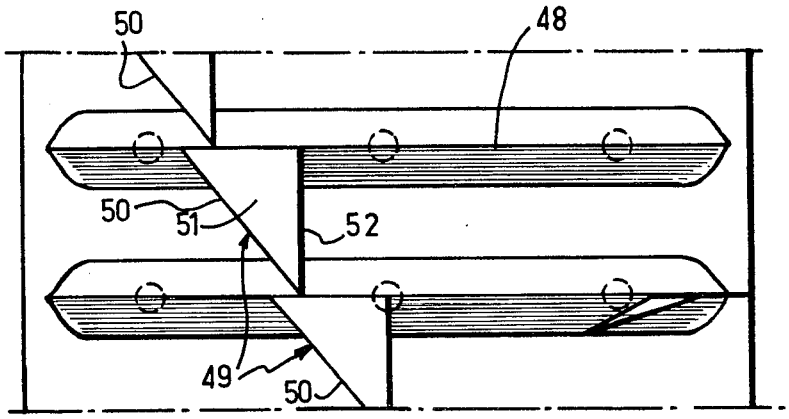
FIGS. 5 and 6 are developed views, in plan and perspective respectively, of the inside wall of said cylinder
Figure 6:
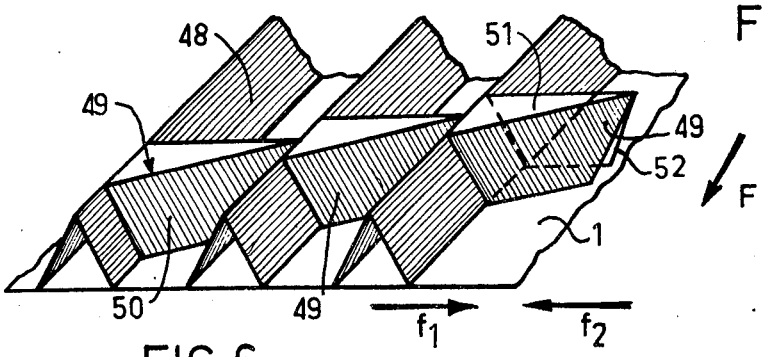
Figure 4:
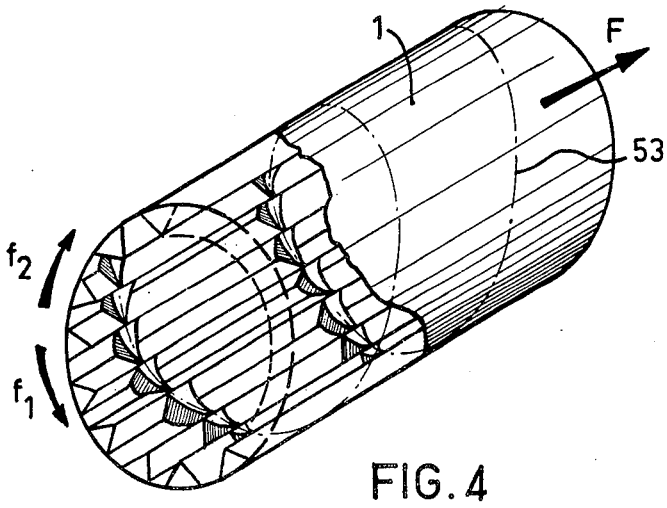
FIG. 4 is a partly cut-away perspective view of said cylinder.

To achieve the most satisfactory result, vanes 44 and 48 are welded to frusto-conical and cylindrical portions 29 and 28 respectively. In the case of the cylindrical portion 28, a cylindrical sheet may advantageously be folded in such a way as to form both the cylindrical portion 28 and the vanes 48 (FIG. 2). In this way heat is properly transmitted to the particles under all circumstances.

Figure 7:
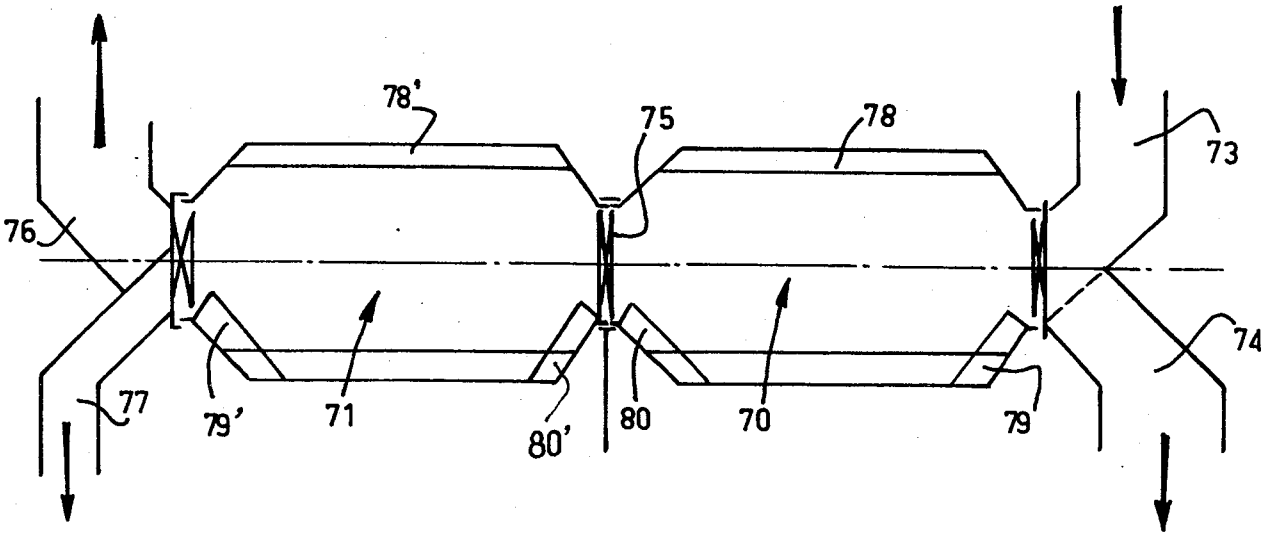
FIG. 7 is a schematic axial section through a modified embodiment according to the invention.

As a modification, a freeze-drying apparatus (FIG. 7) may be formed with two cylindro-conical enclosures 70 and 71 as described above, in order to be able to subject the particles to different types of treatment. The first sublimating enclosure 70 is equipped with a loading device 73 and a discharge device 74 while the two cylinders are connected axially in line by a valve 75. The second cylinder 71 has a passage 76 which acts as an extraction duct for vapours from both enclosures, and a discharge passage 77. Both cylinders 70 and 71 have portions 78 and 78' with cylindrical sets of vanes and portions 79 and 79' respectively upstream and downstream with frusto-conical sets of vanes, while enclosure 70 alone has a second downstream frusto-conical set of vanes 80, the upstream frusto-conical set 80' in enclosure 71 being optional.

The invention is applicable to freeze-drying biological, pharmaceutical and food products.

I claim:

1. Apparatus for the lyophilization of particles of material of the type comprising at least one sublimation enclosure rotating around a horizontal axis, said enclosure having an axial opening communicating with admission and discharge passage both downwardly inclined, said enclosure having a frusto-conical part around said opening and a cylindrical part, said frusto-conical part being fitted with substantially radial vanes extending from the immediate vicinity of said opening and having the form of a catchment through, while said cylindrical part has longitudinal vanes between which is located a series of guides, formed on one transverse side of deflecting walls substantially arranged along a helical line and on the other transverse side by radial blanking-off walls.

2. Apparatus for lyophilization according to claim 1, wherein the guides have also coaxial blanking-off walls.

3. Apparatus for the lyophilization of particles of material of the type comprising at least one sublimation enclosure rotating around a horizontal axis, said enclosure having an axial opening communicating with admission and discharge passages both downwardly inclined, said enclosure having a frusto-conical part around said opening and a cylindrical part, said frusto-conical part having substantially radial vanes on the inner surface thereof extending from the immediate vicinity of said opening, said cylindrical part having longitudinal vanes thereon, means on said cylindrical part presenting to said particles surfaces that are inclined toward said opening in one direction of rotation of said enclosure about said axis thereby to urge said particles toward said opening, means masking said surfaces from said particles upon rotation of said enclosure in the other direction about said axis, and means for rotating said enclosure selectively in either said direction about said axis.

* * * * *